US010215141B2

(12) United States Patent
Reitmeyer

(10) Patent No.: US 10,215,141 B2
(45) Date of Patent: Feb. 26, 2019

(54) SYSTEM AND APPARATUS FOR VAPOR DETECTION WITHIN FUEL SUPPLY MODULE

(71) Applicant: Timothy J. Reitmeyer, Appleton, WI (US)

(72) Inventor: Timothy J. Reitmeyer, Appleton, WI (US)

(73) Assignee: WELLS VEHICLE ELECTRONICS L.P., Fond Du Lac, WI (US)

( * ) Notice: Subject to any disclaimer, the term of this patent is extended or adjusted under 35 U.S.C. 154(b) by 0 days.

(21) Appl. No.: 15/798,065

(22) Filed: Oct. 30, 2017

(65) Prior Publication Data

US 2018/0195474 A1 Jul. 12, 2018

Related U.S. Application Data

(60) Provisional application No. 62/414,429, filed on Oct. 28, 2016.

(51) Int. Cl.

| | |
|---|---|
| ***F02M 37/18*** | (2006.01) |
| ***F02M 37/00*** | (2006.01) |
| ***F02M 37/08*** | (2006.01) |
| ***F02M 37/20*** | (2006.01) |

(52) U.S. Cl.

CPC ..... *F02M 37/18* (2013.01); *F02M 37/0088* (2013.01); *F02M 37/08* (2013.01); *F02M 37/20* (2013.01)

(58) Field of Classification Search

CPC .... F02M 37/0088; F02M 37/08; F02M 37/18; F02M 37/20; F02M 65/003

See application file for complete search history.

(56) References Cited

U.S. PATENT DOCUMENTS

| | | | | |
|---|---|---|---|---|
| 6,390,871 | B1 * | 5/2002 | Wickman | B63H 21/38 123/41.31 |
| 6,527,603 | B1 * | 3/2003 | Wickman | B63H 21/38 123/509 |
| 6,899,580 | B1 * | 5/2005 | Kollmann | B63J 2/12 123/509 |
| 7,178,512 | B1 * | 2/2007 | Merten | F02M 37/10 123/516 |
| 7,832,380 | B1 * | 11/2010 | Abou Zeid | F02M 37/0052 123/519 |
| 9,482,175 | B1 * | 11/2016 | Torgerud | F02D 41/3082 |
| 2005/0000495 | A1 * | 1/2005 | Hamada | F02M 37/0058 123/516 |
| 2011/0231082 | A1 * | 9/2011 | Saruwatari | F02D 41/0042 701/104 |

(Continued)

*Primary Examiner* — Hung Q Nguyen
*Assistant Examiner* — Mark L Greene
(74) *Attorney, Agent, or Firm* — Barnes & Thornburg LLP; Mark J. Nahnsen

(57) ABSTRACT

A system and method of detecting the presence of fuel vapor gases within a fuel supply module tank. The system includes a lift pump for filling the fuel supply module reservoir with liquid fuel from the main fuel tank. The fuel supply module reservoir may include a certain amount of fuel vapor and air, which is detected by a pressure sensor. If a resting pressure is detected, a control module runs the lift pump to pump liquid fuel into the fuel supply module reservoir and purges the vapor and air from the reservoir.

17 Claims, 10 Drawing Sheets

(56) References Cited

U.S. PATENT DOCUMENTS

| | | | | |
|---|---|---|---|---|
| 2013/0104851 | A1* | 5/2013 | Falkowski | F02D 41/32<br>123/446 |
| 2014/0127066 | A1* | 5/2014 | Weckerly | F04B 49/03<br>417/533 |
| 2015/0345456 | A1* | 12/2015 | Drabek | F02M 37/10<br>123/461 |

* cited by examiner

SYSTEM AND APPARATUS FOR VAPOR DETECTION WITHIN FUEL SUPPLY MODULE

CROSS-REFERENCE TO RELATED APPLICATION

The present invention claims priority to U.S. Provisional Application No. 62/414,429, filed Oct. 28, 2016, the entirety of which is incorporated by reference herein.

BACKGROUND

The present disclosure relates to fuel supply systems for internal combustion engines, and particularly to fuel supply modules. More particularly, the present disclosure relates to a fuel supply system that detects the presence and purges fuel vapor. It is necessary in combustion engines to ensure the proper supply of liquid fuel at all times. Vapors existing within the fuel supply system can result in delayed response to changes in pump pressure to the engines supply, as well as the feeding of vapors instead of fuel during engine activity, impacting performance and possibly resulting in damage.

SUMMARY

According to the present disclosure, a method of detecting the presence or absence of vapor is provided within the fuel supply module of recreational vehicles and boats.

In illustrative embodiments, a pressure sensor is used to measure the pressure in a fuel supply module tank. The fuel supply module tank is an intermediate tank located between the main fuel tank or tanks and the engine fuel rail. While the fuel supply module tank is simultaneously filled with liquid gasoline, from the main fuel tank, and creating engine rail pressure (and venting off of vapors), the tank can be considered fully filled and venting process completed by a significant increase in measured pressure. In essence, once all compressible vapors have been removed from the system, tank pressure increases.

In illustrative embodiments, a system and method of detecting the presence of fuel vapor gases within a fuel supply module tank or holding tank is provided. The system includes a lift pump for filling the fuel supply module tank with liquid fuel from the main fuel tank. The fuel supply module tank may include a certain amount of fuel vapor and air, which is undesirable because it can cause drops in fuel rail pressure and engine issues. Unwanted fuel vapor could also be a fire hazard, creating a potentially unsafe condition. A rail pump is utilized for removing fuel from the fuel supply module tank and transferring the fuel to the engine fuel rail. The rail pump first draws any vapor from the fuel supply module tank which may exist at the top of the tank and then draws liquid fuel.

In illustrative embodiments, the system includes a pressure sensor positioned at the head of the fuel supply module tank. Pressure readings taken by the pressure sensor will remain at or below a resting pressure during the filling period as liquid is added to the fuel supply module tank by the lift pump and vapors are removed from the fuel supply module tank by the rail pump. The vapors are moved by the rail pump to the fuel rail, where it is purged from the injectors. When all vapors are removed from the fuel supply module tank, and liquid has completely filled the fuel supply module tank, a large spike in pressure detected by the pressure sensor will occur. The large spike in pressure signals to a control module that completion of filling the fuel supply module tank with fuel and bleeding off any vapor within the fuel supply module tank has been completed.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
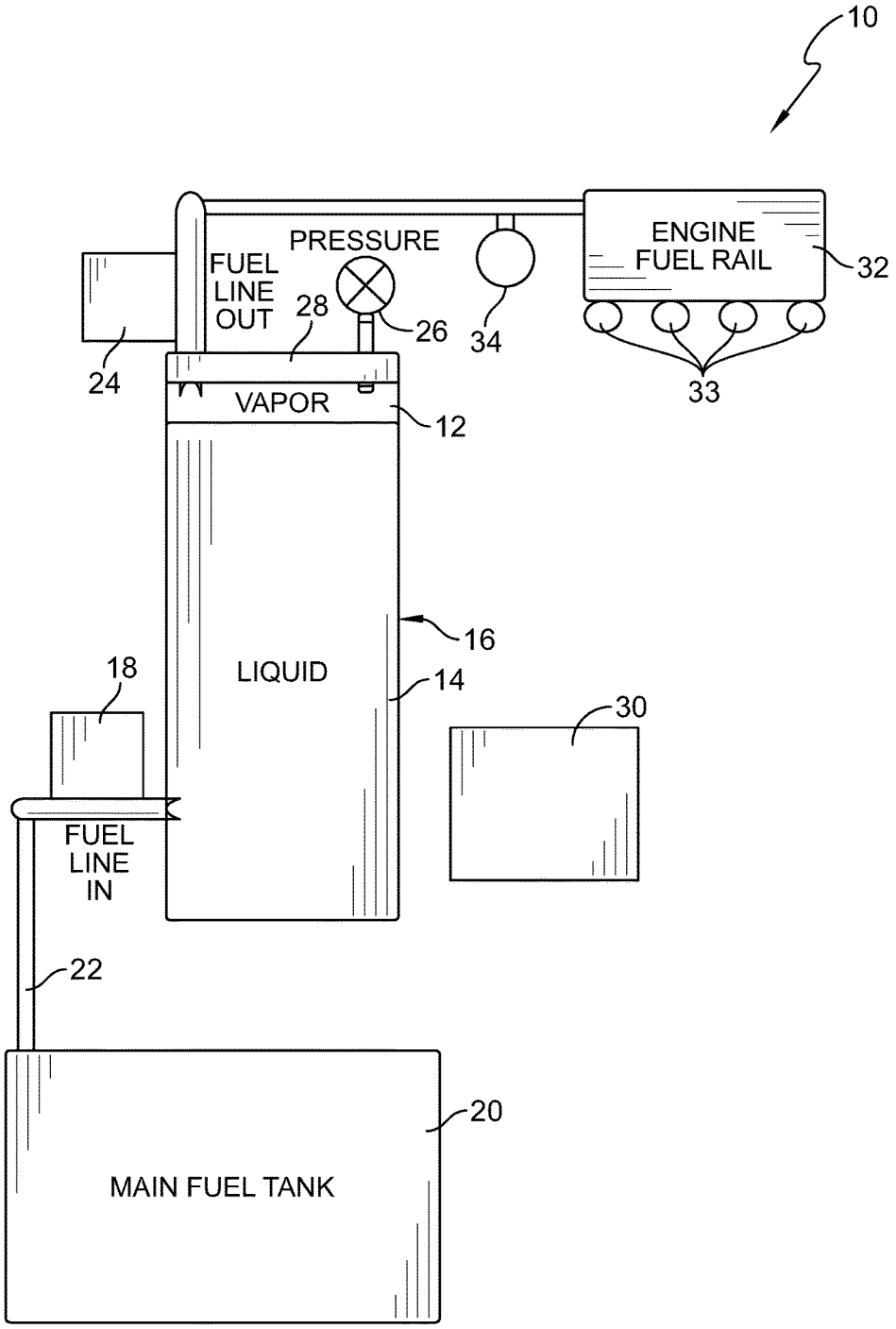
FIG. 1 is a schematic view of a system for detecting the presence of fuel vapor gases within a fuel supply module tank.

A system 10 and apparatus for vapor detection within a fuel supply module tank 16 in accordance with the present disclosure is shown in FIG. 1. The system is designed to detect the presence of fuel vapor 12 alone or with liquid fuel 14 within the fuel supply module reservoir 16 is provided. The system and method includes a lift pump 18 that is used to fill the fuel supply module tank 16 with liquid fuel 14 from a main fuel tank 20 through fuel supply line 22. During the normal course of operation, the fuel supply module reservoir 16 may contain a certain amount of fuel vapor 12 and/or air, which is undesirable in the fuel system because the vapor can cause a drop in fuel rail 32 pressure and ultimately engine issues.

In illustrative embodiments, a rail pump 24 is utilized for removing vapor 12 and liquid fuel 14 from the fuel supply module reservoir, as shown in FIG. 1. The rail pump 24 is mounted near a head end 28 of fuel supply module reservoir 16. The rail pump 24 is coupled to and in fluid communication with a fuel rail 32 of an engine. The fuel rail 32 provides pressurized fuel to a series of fuel injectors 33 which atomize fuel which is consumed during the combustion process. The rail pump 24 first draws any vapor 12 from the fuel supply module reservoir 16 which may exist at the top of reservoir 16 and then draws liquid fuel 14, when all vapor 12 has been purged. The vapor 12 is pushed out through the fuel rail 32 and out through the fuel injectors 33.

The system 10 includes a pressure sensor 26 positioned at the head 28 of the fuel supply module reservoir 16, as shown in FIG. 1. Pressure readings taken by the pressure sensor 26 will remain at or below a resting pressure (P1) during the filling period as liquid 14 is added to the fuel supply module reservoir 16 by the lift pump 18 and vapors are removed from the fuel supply module tank by the second pump, as shown, for example, in FIG. 2. Pressure sensor 26 will rise above the resting pressure (P2) after the vapor has been purged from the fuel supply module reservoir 16 by the lift pump 18 as shown, for example, in FIG. 3.

When the vapor 12 has been completely removed from the fuel supply module reservoir 16, and liquid fuel 14 has taken its place, a large spike in pressure will occur in the fuel supply module reservoir 16. The pressure sensor 26 detects the large spike in pressure and signals to a control module 30 that completion removal of any vapor 12 within the fuel supply module tank 16 has been completed. Pressure sensor 26 sends a signal to the control module 30 when the pressure spike in the fuel supply module tank 16 has occurred.

The control module 30 receives input signals from the pressure sensor 26. If vapor is present in the fuel supply module tank 16 and the pressure is below the threshold pressure, the control module 30 will energize the lift pump 18. As part of the start-up procedure, control module 30 may run both the lift pump 18 and rail pump 24 simultaneously in order to fill the fuel supply module tank 16 and to pressurize the fuel rail 32. The control module 30 may also run one of the pumps at a faster rate than the other depending upon whether vapor needs to be purged from the fuel supply module tank 16 or the pressure in the fuel rail 32 needs to be increased. The fuel rail 32 supplies pressure to the fuel injectors so that atomized fuel is available for the combustion process.

The rail pump 24 preferably maintains the fuel line and fuel rail 32 at about 50 psi, for example. The fuel pressure in the fuel rail 32 can be set higher or lower depending upon the application. A second pressure gauge 34 in the fuel line is positioned between the rail pump 24 and the fuel rail 32 and is used to monitor the line pressure. The second pressure gauge 34 provides an output signal to the control module 30. When the fuel rail 32 reaches 50 psi, the control module 30 turns off the rail pump 24 until the pressure in the fuel rail 32 drops below a predetermined level. The lift pump 18 can be run independently of the rail pump 24 as needed to maintain the level of fuel in the fuel supply module tank 16 or to purge vapor 12 or both.

Figure 2:
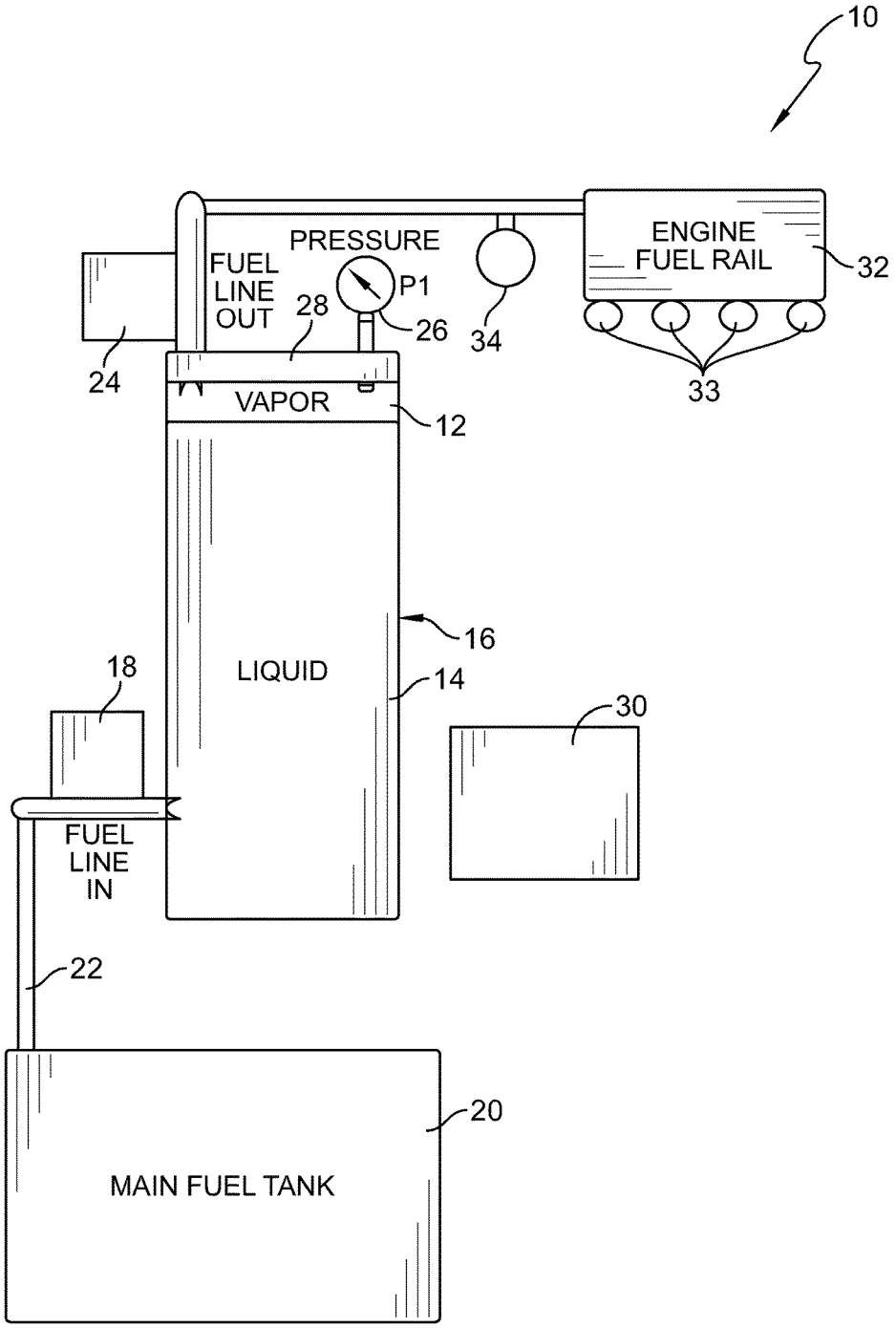
FIG. 2 is another view of the system of FIG. 1 showing the pressure gauge at P1 showing that the fuel supply module tank pressure is below a threshold pressure which indicates that there is unwanted vapor in the fuel supply module tank requiring energizing of a lift pump.
Figure 3:
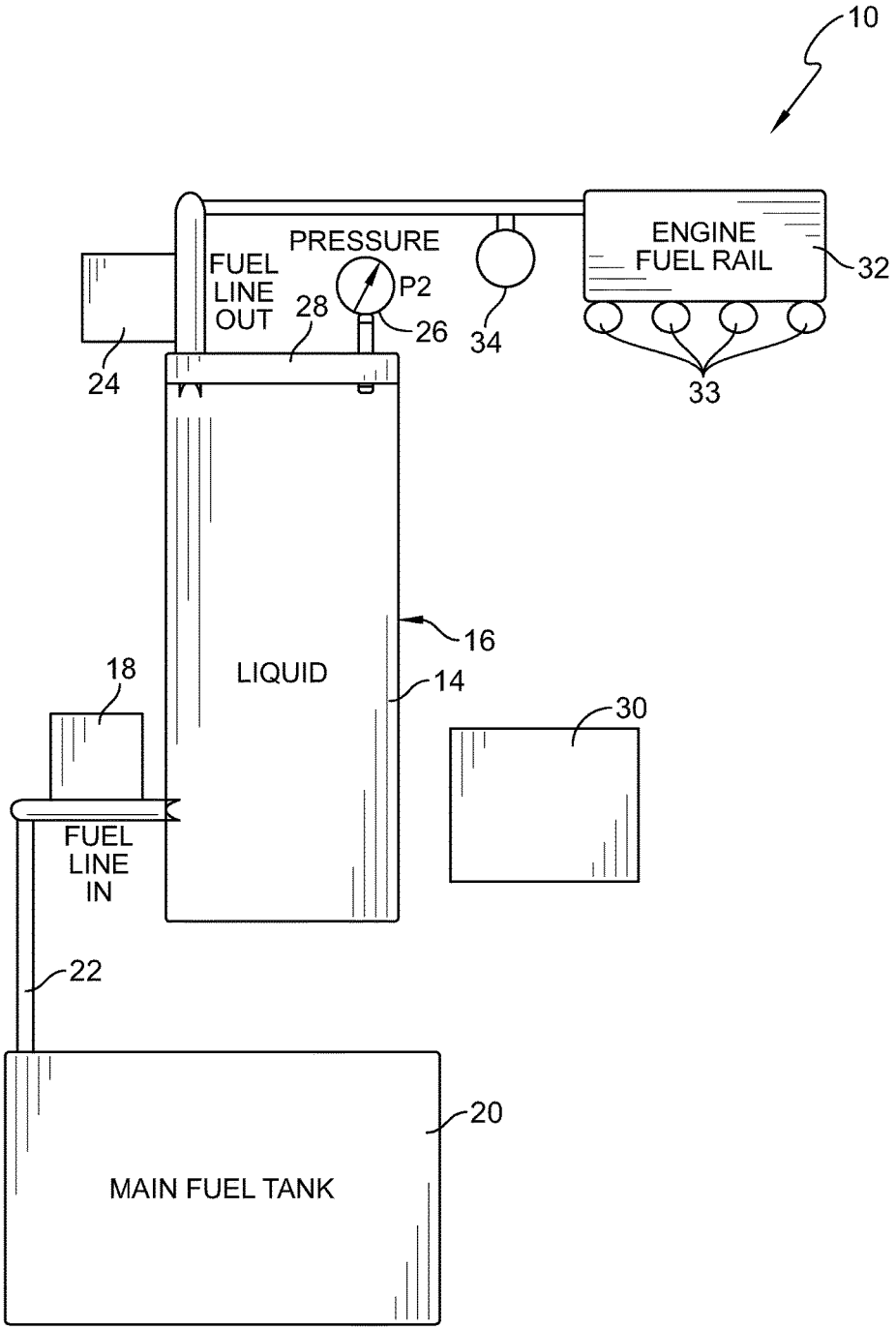
FIG. 3 is another view of the system of FIG. 1 showing the pressure gauge at P2, showing that the fuel supply module tank pressure is above the threshold pressure, which indicates that the vapor have been purged from the fuel supply module tank and the lift pump is turned off.
Figure 4:
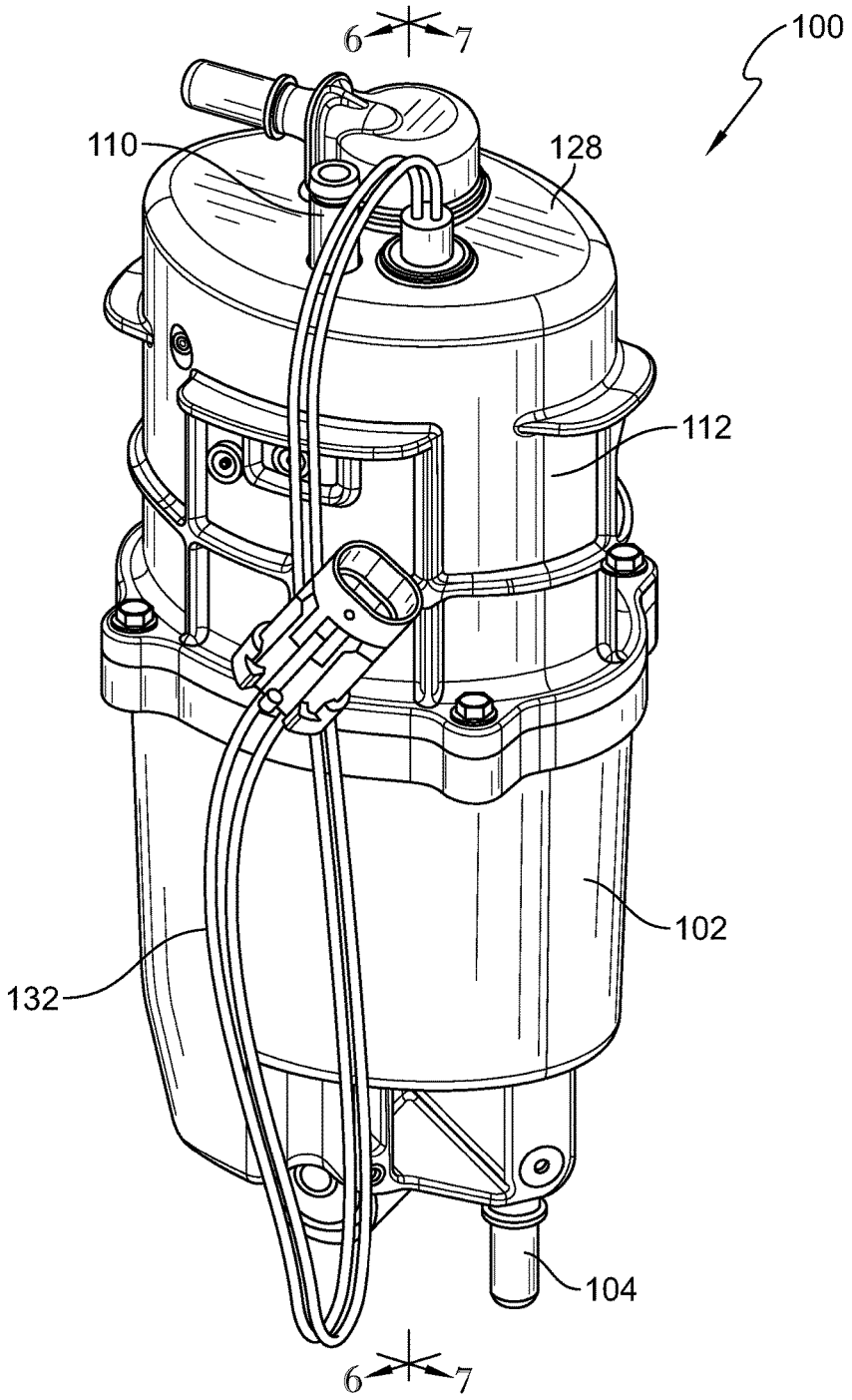
FIG. 4 is a perspective view of the fuel supply module showing the reservoir housing, a fuel inlet at the bottom, a fuel outlet at the top, and an electrical connector for the pump motors.

At startup, if the control module 30 uses the pressure sensor 26 in the fuel supply module reservoir 16 to determine whether the fuel supply module reservoir 16 is at resting pressure. If it is at resting pressure, the control module 30 energizes the lift pump 18 to pump liquid fuel 14 from the main fuel tank 20 into the fuel supply module reservoir 16 to purge all vapor 12 from the fuel supply module tank 16, as shown in FIG. 2.

Once the fuel supply module tank 16 is completely purged of vapor 12, the pressure sensor 26 senses a spike in pressure and transmits a signal to the control module 30 which, in turn, cuts or reduces power to the lift pump 18. The rail pump 24 may or may not be running while the lift pump 18 is running to eliminate air and vapor 12 from the fuel supply module tank 16. The control module 30 runs the rail pump 24 when needed to ensure the fuel rail 32 is at the desired pressure. In some situations, the lift pump 18 and the rail pump 24 may be running at the same speeds so that fuel delivery to the fuel injectors is constant and at the correct pressure.

Figure 5:
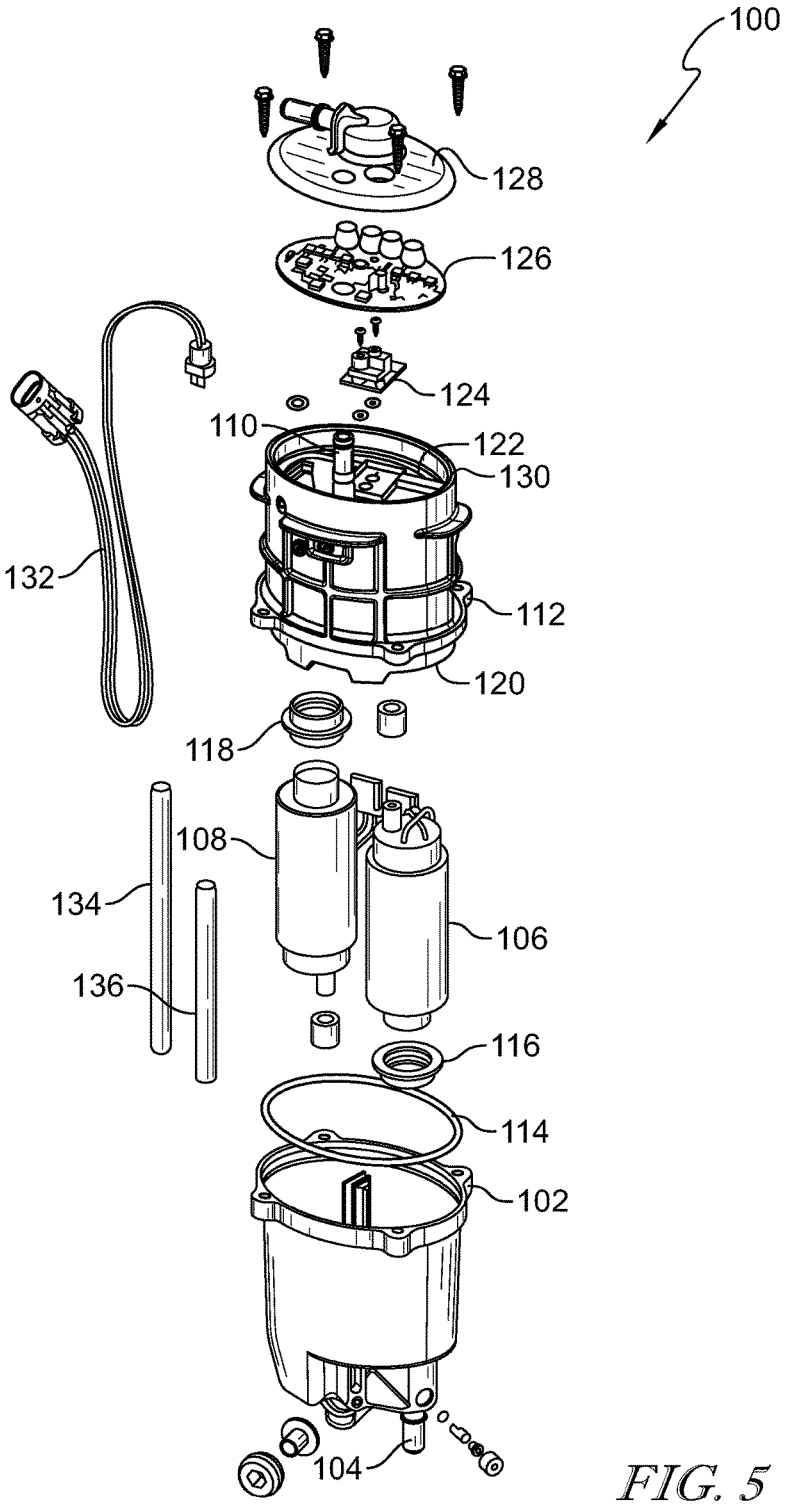
FIG. 5 is an exploded view of the fuel supply module of FIG. 4 showing the reservoir bottom housing, a lift pump and a fuel rail pump that are positioned within the reservoir bottom housing, a reservoir top housing, a circuit board and a cover.

FIG. 5 is an exploded view of the fuel supply module 100 of the present disclosure. The fuel supply module 100 includes a reservoir bottom housing 102 that includes an inlet port 104 to supply the reservoir with fuel. Lift pump 106 draws fuel into the reservoir through inlet port 104 to fill the reservoir. Fuel rail pump 108 is also positioned within reservoir bottom housing 102 and draws fuel from the reservoir and pressurizes the fuel and causes it to exit from outlet port 110.

Reservoir upper housing 112 of fuel supply module 100 is secured to reservoir bottom housing 102 with fasteners. Upper housing 112 is sealed to bottom housing 102 with a gasket 114 to prevent the leakage of fuel and form the reservoir. Lift pump 106 includes a gasket 116 that seals the lower end of the lift pump 106 to the bottom housing 102. Fuel rail pump 108 includes a gasket 118 that seals the fuel rail pump 108 to the upper housing 112.

Figure 9:
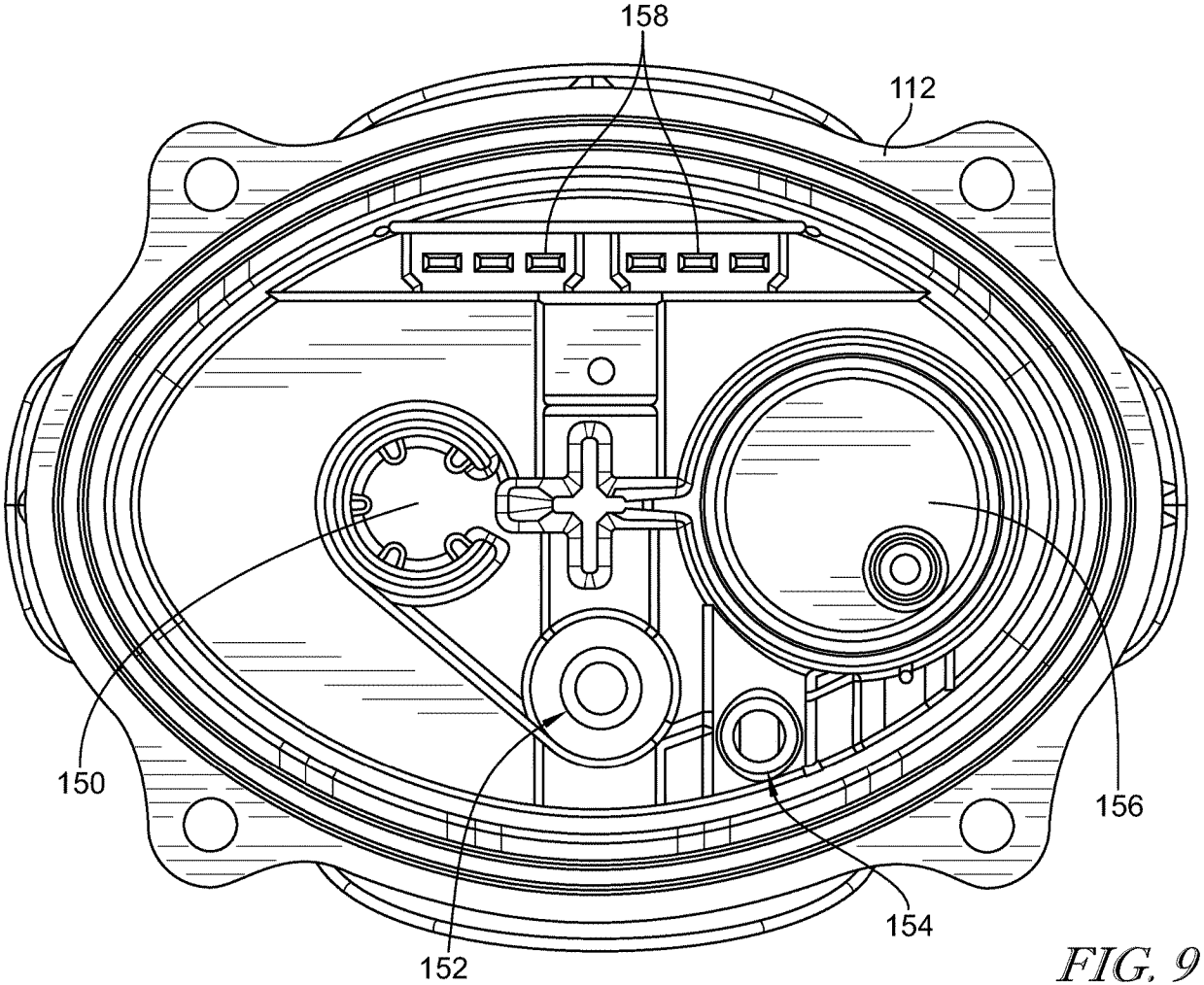
FIG. 9 is an elevational view of the inside of the top reservoir showing the lift pump outlet, the feed pump inlet, the draw straw port and the plumbing line port.
Figure 10:
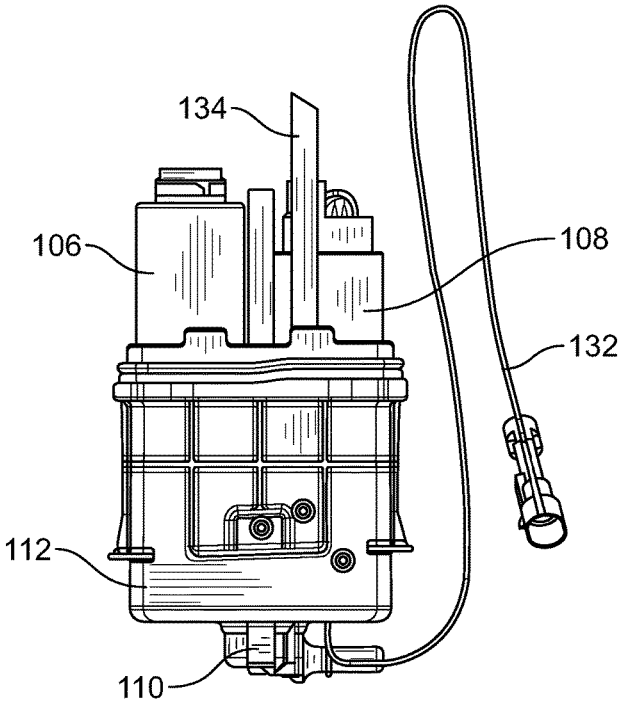
FIG. 10 is a side elevational view of the fuel supply module with the lower reservoir removed.
Figure 11:
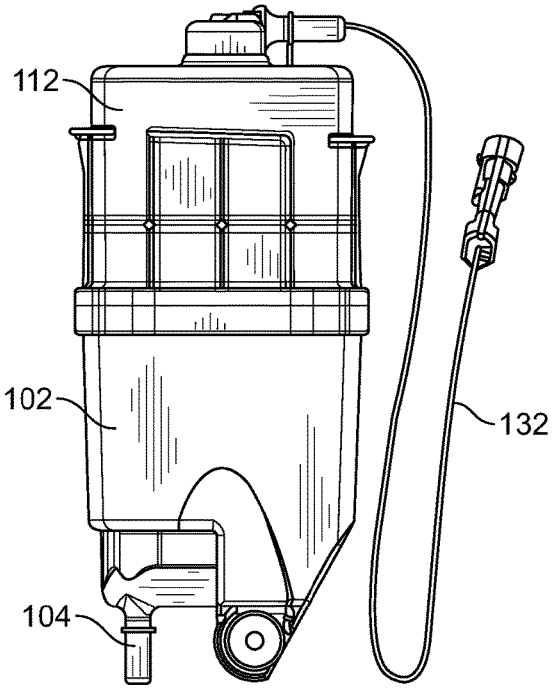
FIG. 11 is another side elevational view of the fuel supply module.

Reservoir upper housing 112 of fuel supply module 100 includes a bottom side 120 and an upper side 122. Bottom side 120 of upper housing 112, as shown in FIGS. 5 and 9 are adapted to house a portion of the fuel pumps 106, 108. Upper side 122 of upper housing 112 is adapted to contain a pressure sensor 124 and a circuit board 126. Upper side 122 of upper housing 112 is enclosed with a cap 128 and sealed to upper housing 112 with gasket 130. Electrical connector 132 is adapted to be passed through the cap 128 and secured to circuit board 126. Pressure sensor 124 is adapted to measure the pressure in the reservoir and provide the information to the controller that is part of the circuit board 126. Cap 128 includes outlet port 110 that permits fuel to exit the fuel supply module 100. The upper portion of the upper housing 112 is sealed so that the pressure sensor 124 and the circuit board 126 remain dry.

Fuel supply module 100 also includes a draw tube 134 that allows for fuel to be drawn from the reservoir by the fuel rail pump 108. Fuel supply module 100 also includes a plumbing tube 136 which allows the fuel rail pump 108 to pump fuel out outlet port 110.

Figure 7:
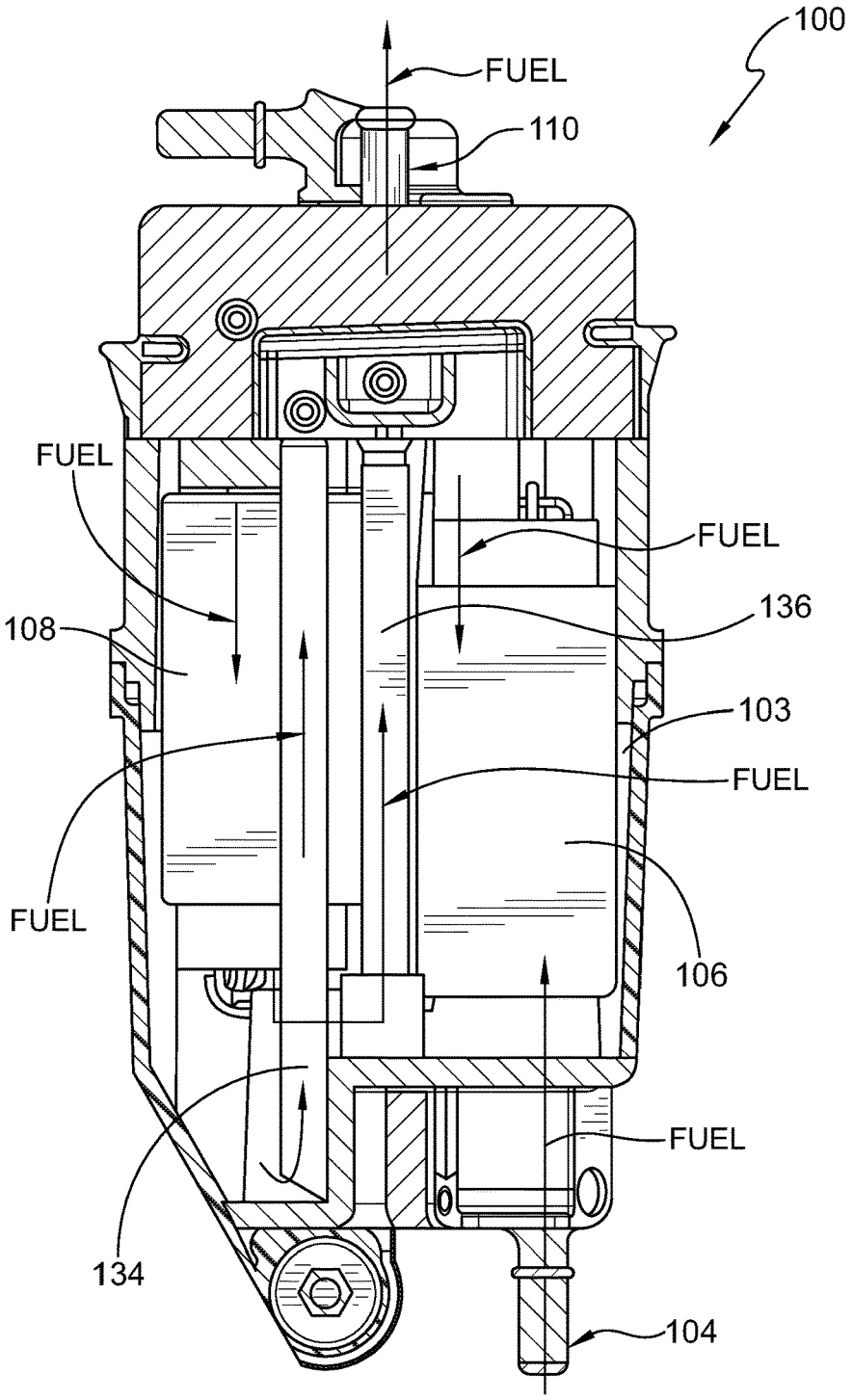
FIG. 7 is another sectional view of the fuel supply module showing the pathway of fuel through the module.

In use, the lift pump 106 draws fuel up from the fuel tank of the vehicle through the inlet port and dumps the fuel into the reservoir 103 or holding tank, filling the reservoir, as shown in FIG. 7. Lift pump 106 continues to fill reservoir 103 until the reservoir is pressurized. Pressure sensor 124 measures pressure in the reservoir 103 and sends a signal to the control module 30 of the circuit board 126 if the fuel pressure drops below a threshold pressure to ensure that there is no vapor present in the reservoir 103.

Figure 6:
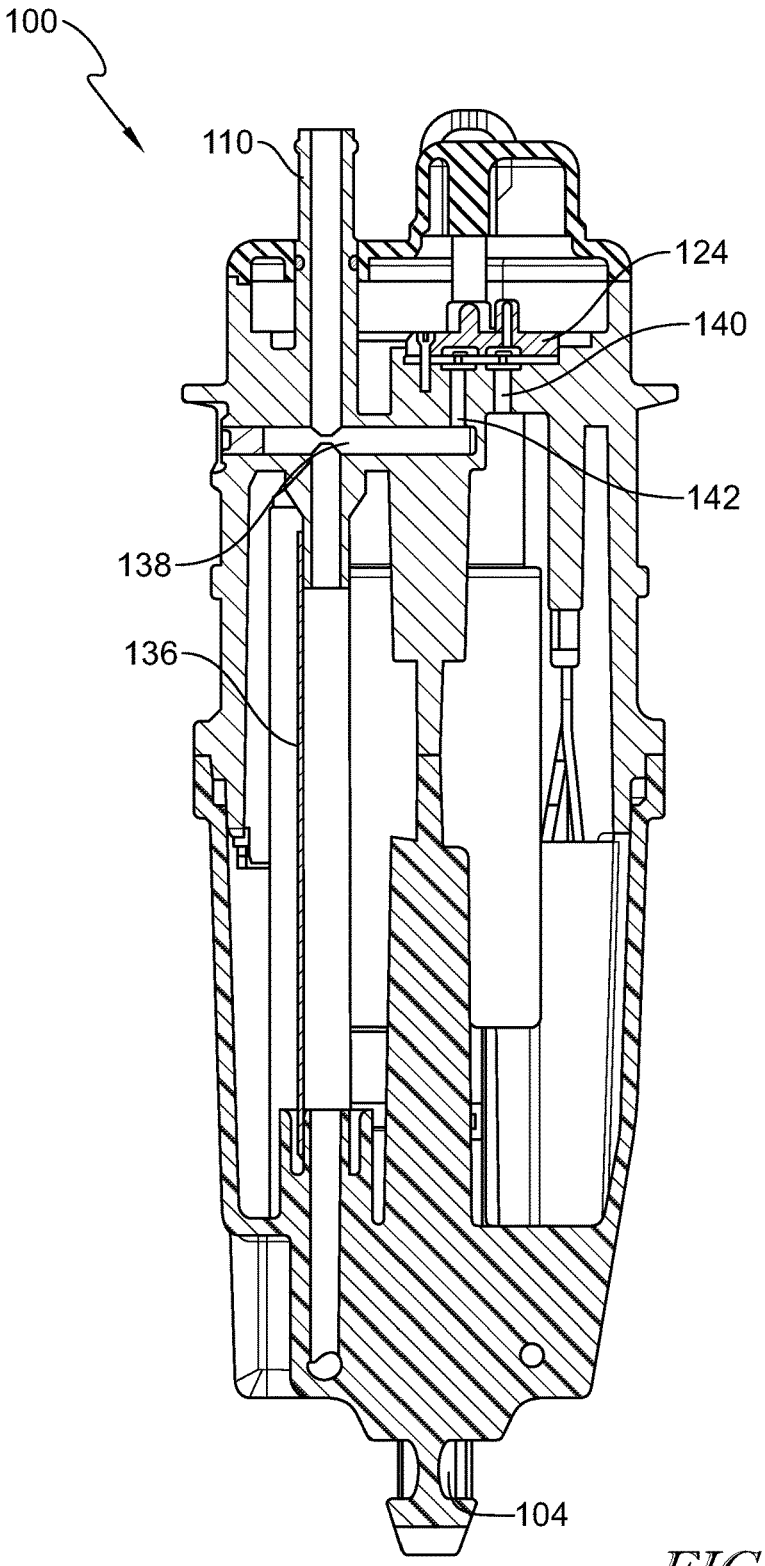
FIG. 6 is sectional view of the fuel supply module showing the location of the fuel pumps within the housing and showing the internal passageways of the module.

Next, the fuel rail pump 108 of the fuel supply module 100 uses draw tube 134 to draw fuel from the bottom of the reservoir 103 and ultimately to the fuel rail of a vehicle. The fuel is pressurized by the fuel rail pump 108 and up the plumbing tube 136 and out of outlet 110 to the fuel rail of the vehicle. The fuel rail pump 108 first draws any vapor from the reservoir 103 which may exist at the top of reservoir 103 and then draws fuel, when all vapor has been purged. The fuel rail pump 108 pressurizes the fuel to about 50 psi. The fuel is pumped over and up into the plumbing tube 136 where it intersects with the fuel rail manifold 138, as shown in FIG. 6. Fuel rail manifold 138 is in fluid communication with a rail pressure port 142 that is connected to the pressure sensor 124.

There also is a canister pressure port 140 that allows the pressure sensor 124 to determine the pressure within the reservoir 103. Pressure sensor 124 provides pressure readings to the controller 30 so that controller can either energize the lift pump 106 or the fuel rail pump 108 or both pumps to increase the pressure in the fuel rail or in the reservoir to ensure that proper pressure is maintained. Both pumps 106 and 108 are variable speed dc pumps that can be increased or decreased incrementally depending upon flow and pressure needs in the fuel rail and the reservoir 103.

Figure 8:
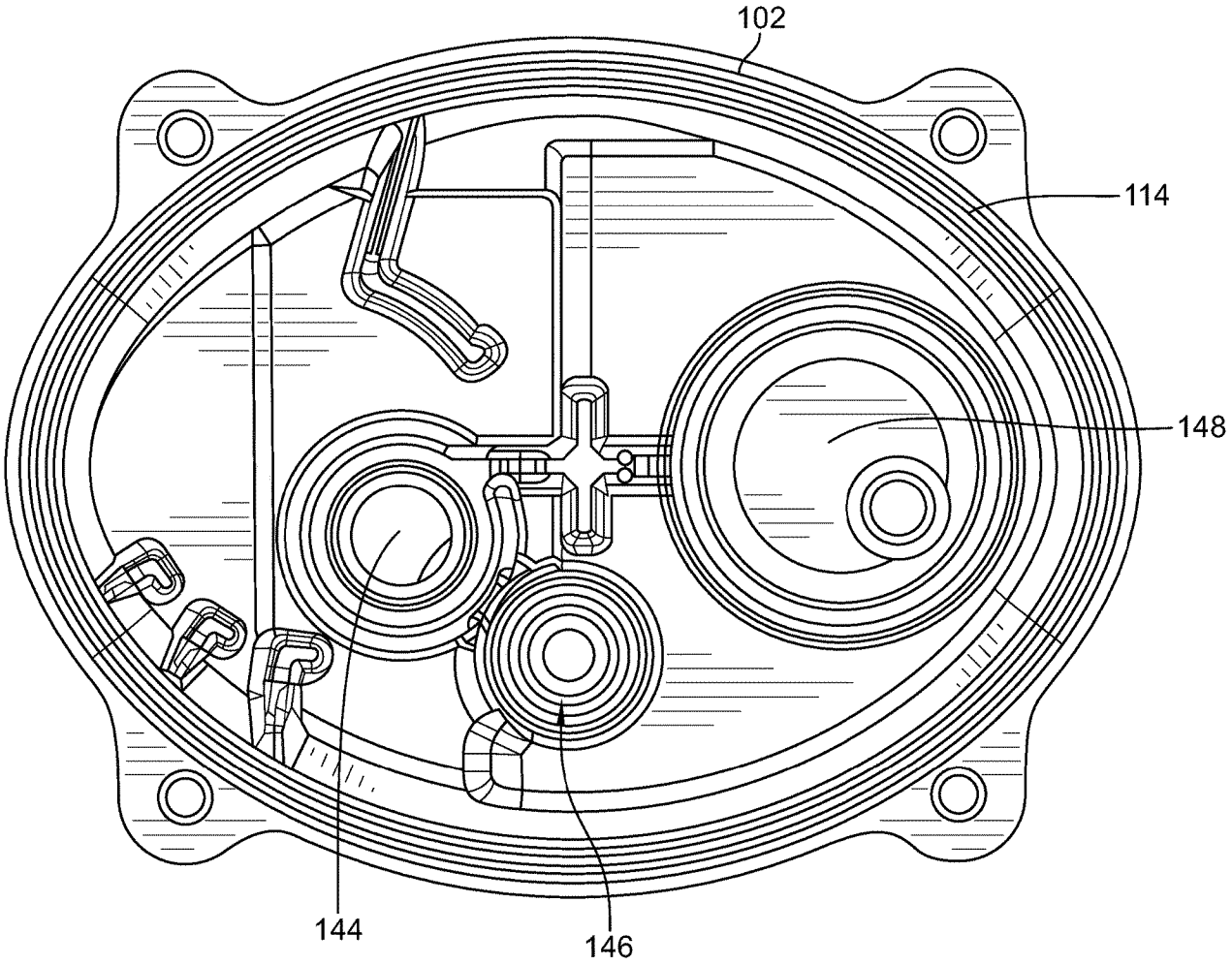
FIG. 8 is a elevational view of the inside of the reservoir bottom housing showing the lift pump inlet, the feed pump outlet and a plumbing port.

FIG. 8 illustrates the inside of the bottom housing 102 and shows the lift pump inlet 148 that permits fuel to be drawn into inlet 104 of bottom housing 102. Bottom housing 102 also includes the location of the pressure rail outlet 144 where the fuel rail pump 108 is coupled. Bottom housing 102 also includes a plumbing line port 146 that is adapted to accept plumbing tube 136 to allow pressurized fuel to extend upward into the fuel rail manifold 138.

FIG. 9 illustrates the inside of the upper housing 112 and illustrates the lift pump outlet 150, which is the location where the upper portion of the lift pump 106 is located. The upper housing 112 also includes the pressure rail inlet 156 where the fuel rail pump 108 is coupled. The upper housing 112 also includes a plumbing line port 152 that is adapted to accept the upper portion of the plumbing tube 136 to allow pressurized fuel to extend upward into the fuel rail manifold 138. Also included in the upper housing 112 is the draw straw port 154. The draw straw port 154 is adapted to accept the upper end of the draw straw 134 so that fuel can be drawn from the reservoir 103. Also provided are electrical connectors 158 to allow for the electrical connection of the pumps 106, 108.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for detecting and removing gases within a fuel supply module reservoir positioned between a main tank and a fuel rail of a fuel injection system comprising:

a. providing a first pump for transferring liquid fuel from the main tank to the fuel supply module reservoir;

b. providing a second pump for removing fluid from the fuel supply module reservoir, drawing first from any vapor which may exist at the top of the fuel supply module reservoir and then from the liquid fuel;

c. providing a pressure sensor that takes pressure readings from the fuel supply module reservoir wherein the pressure readings taken by the pressure sensor will remain at or below a resting pressure during a filling period of the fuel supply module reservoir as the liquid fuel is added and the vapor is removed; and d. wherein when all the vapor is removed and the liquid has completely filled the fuel supply module reservoir, an increase in pressure in the fuel supply module reservoir is measured by the pressure sensor, which signals the completion of fuel filling and vapor bleeding of the fuel supply module reservoir.

2. A fuel vapor detection system comprising:

a fuel system having a main fuel tank, a fuel supply module reservoir and a fuel rail;

a first fuel pump that is adapted to transfer a fuel from the main fuel tank to the fuel supply module reservoir;

a second fuel pump that is adapted to transfer the fuel from the fuel supply module reservoir to the fuel rail, wherein the second fuel pump pressurizes the fuel rail to a predetermined pressure;

a pressure sensor coupled to the fuel supply module reservoir that is adapted to detect the pressure within the fuel supply module reservoir;

a processor that is adapted to receive an input signal from the pressure sensor and selectively energizes the first fuel pump to pump liquid fuel into the fuel supply module reservoir until a vapor within the fuel supply module reservoir is purged and the pressure sensor reaches a predetermined pressure value.

3. The fuel vapor detection system of claim 2 wherein the fuel supply module reservoir includes an upper housing and a lower housing.

4. The fuel vapor detection system of claim 3, wherein the first fuel pump and the second fuel pump are positioned within the upper housing and the lower housing.

5. The fuel vapor detection system of claim 2 further including a manifold and wherein the second fuel pump pumps the fuel to the manifold.

6. The fuel vapor detection system of claim 5, wherein the manifold is in fluid communication with a rail pressure port that is connected to the pressure sensor.

7. The fuel vapor detection system of claim 6, further including a canister pressure port that is in fluid communication with the fuel supply module reservoir and is connected to the pressure sensor to allow the pressure sensor to measure the pressure within the fuel supply module reservoir.

8. The fuel vapor detection system of claim 7 wherein the pressure sensor provides pressure readings to the processor so that the processor can either energize the first pump or the second pump, or energize both the first pump and the second pump to increase the pressure in the fuel rail or in the fuel supply module reservoir to ensure that proper pressures are maintained in both.

9. A fuel supply module for a motor comprising:

a housing having an interior reservoir and having an inlet adapted to permit inflow of a fuel and an outlet to permit of the fuel;

a first fuel pump positioned within the housing and in fluid communication with the inlet, the first fuel pump adapted to draw the fuel from the inlet and deposit the fuel within the internal reservoir of the housing;

a second fuel pump positioned within the housing, the second fuel pump adapted to pump the fuel from within the internal reservoir of the housing to the outlet;

a pressure sensor adapted to sense both the pressure within the internal reservoir and the pressure of the fuel exiting the second fuel pump;

a controller adapted to receive signals from the pressure sensor regarding the pressure within the internal reservoir and the pressure of the fuel exiting the second fuel pump and energizing the first fuel pump, the second fuel pump or both the first fuel pump and the second fuel pump to maintain desired pressures within the internal reservoir and of the fuel exiting the second fuel pump.

10. The fuel supply module of claim 9, further including a pick up tube that permits the second fuel pump to pump the fuel from the internal reservoir.

11. The fuel supply module of claim 9, wherein the housing includes an upper housing and a lower housing that are interconnected and sealed together.

12. The fuel supply module of claim 11, wherein the upper housing includes a dry chamber for housing the controller and the pressure sensor.

13. The fuel supply module of claim 9, wherein the second fuel pump draws vapor from the internal reservoir to purge the vapor from the internal reservoir.

14. The fuel supply module of claim 13, wherein the controller selectively energizes the first fuel pump to pump the fuel into the internal reservoir until the internal reservoir is purged of the vapor and the pressure sensor reaches a predetermined pressure value of the internal reservoir.

15. The fuel supply module of claim 9 further includes a manifold, wherein the second fuel pump pumps the fuel to the manifold.

16. The fuel supply module of claim 15, wherein the manifold is in fluid communication with a rail pressure port that is connected to the pressure sensor.

17. The fuel supply module of claim 16, further including a canister pressure port that is in fluid communication with the internal reservoir and is connected to the pressure sensor to allow the pressure sensor to measure the pressure within the internal reservoir.

* * * * *